United States Patent [19]

Hart

[11] 3,963,142

[45] June 15, 1976

[54] SIDESEAL CLOSURE CAP AND SEALED PACKAGE

[75] Inventor: Alexander W. Hart, Lancaster, Ohio

[73] Assignee: Anchor Hocking Corporation, Lancaster, Ohio

[22] Filed: June 2, 1975

[21] Appl. No.: 582,650

Related U.S. Application Data

[63] Continuation of Ser. No. 432,079, Jan. 9, 1974, abandoned.

[52] U.S. Cl. ..... 215/346; 215/31; 215/352

[51] Int. Cl.[2] ..... B65D 41/22

[58] Field of Search ..... 215/31, 346, 352, 327, 215/341

[56] References Cited

UNITED STATES PATENTS

| | | | |
|---|---|---|---|
| 651,312 | 6/1900 | Lorenz | 215/352 |
| 697,491 | 4/1902 | Kalling | 215/327 |
| 1,244,495 | 10/1917 | Hammer | 215/327 |
| 1,998,870 | 4/1935 | Hammer | 215/352 X |
| 2,030,062 | 2/1936 | Greene | 215/346 X |
| 2,633,262 | 3/1953 | Acton | 215/346 |
| 2,731,165 | 1/1956 | Hohl | 215/31 X |
| 3,005,563 | 10/1961 | Stover | 215/352 |

*Primary Examiner*—Donald F. Norton

*Attorney, Agent, or Firm*—Holland, Armstrong, Wilkie & Prefito

[57] ABSTRACT

An improved sideseal closure and package are described in which a cut rubber gasket is used in a metal closure shell in a closure cap which is pressed onto containers for forming a sideseal. The closure cap has an integral cover and depending metal skirt with an inwardly facing channel formed in the lower portion of the skirt for receiving the cut rubber sealing gasket. The channel includes an inwardly directed bead at its top above the gasket for assisting in retaining the gasket in place in the closure cap. A preferred gasket cross-section is described for minimizing rolling of the gasket during cap application. A preferred finish for the glass container provides a slightly concaved sealing surface for engaging the gasket which is positioned downwardly from the container rim below a flared and slightly concaved guiding surface between the container rim and the container sealing surface.

5 Claims, 6 Drawing Figures

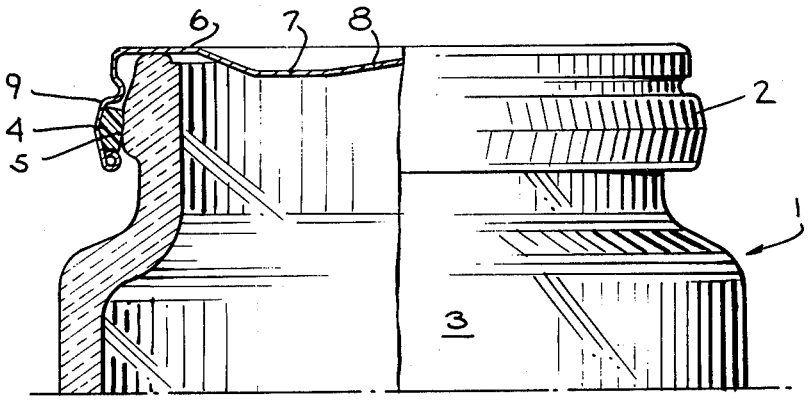
Fig. 1.
Fig. 2.
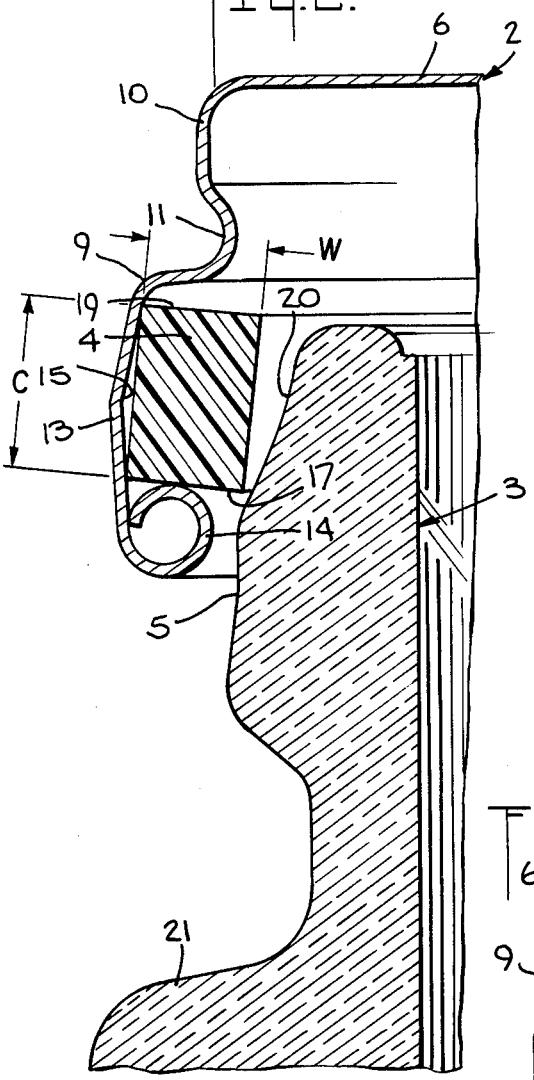
Fig. 3.
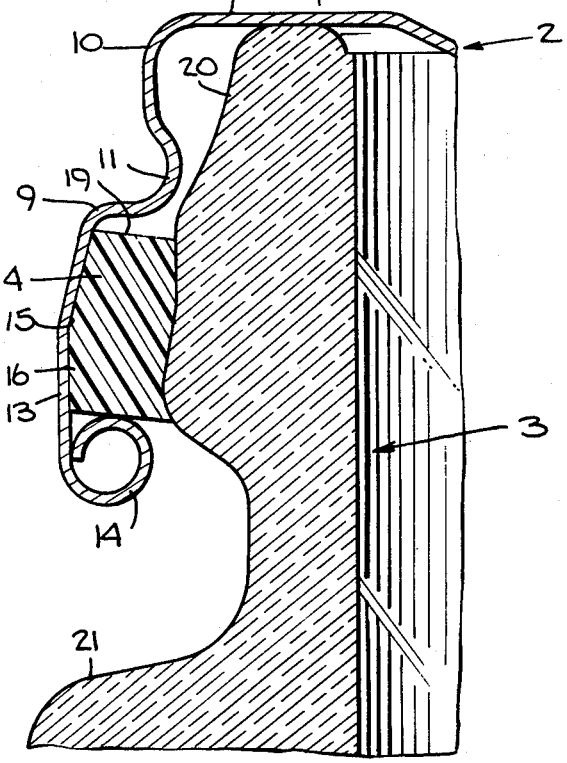
Fig. 4.
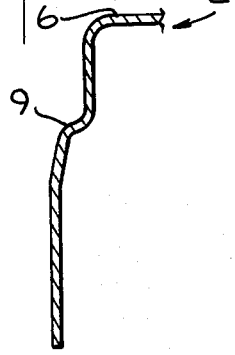
Fig. 5.
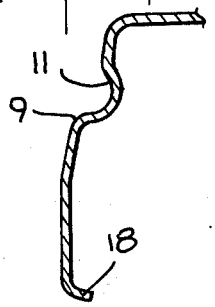
Fig. 6.
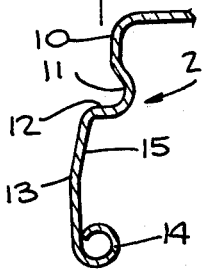

SIDESEAL CLOSURE CAP AND SEALED PACKAGE

This is a continuation of application Ser. No. 432,079 filed Jan. 9, 1974, now abandoned

BACKGROUND OF THE INVENTION

The present invention relates to hermetically sealed packages and in particular to an improved sideseal press-on closure cap and a preferred glass finish for use with the closure to provide an improved seal package. sealed In particular, this invention provides an improved sideseal closure cap of the type in which a cut rubber or rubber-like gasket is mounted in an inwardly facing channel in a cap skirt for forming a seal with a sealing surface spaced downwardly from the rim of a glass container.

The closure cap and the related glass finish are improvements over the cap and sealed package described in U.S. Pat. Nos. 1,909,406 dated May 16, 1933 and 3,005,563 dated Oct. 24, 1961 and owned by the assignee of the present invention. Those patents disclose sideseal closures which are satisfactory for sealing containers using a press-on action particularly for lower sealing speeds and for containers having small or medium sized mouths.

Sideseal closure caps made in accordance with these prior patents and other prior designs have been found satisfactory for certain uses but present problems when used at higher sealing speeds and when used for larger size containers as the gasket rings have exhibited undesirable rolling action during the sealing operations. This has prevented utilization of the desirable higher sealing speeds possible with the newer high capcity cap feeding and sealing equipment and has also tended to cause sealing failures in certain larger package sizes.

The improved design of the present closure incorporating an inwardly rolled bead on the skirt bottom and an inwardly directed bead in the skirt above the gasket together with improved preferred gasket dimensions and an improved cooperating container finish overcomes these drawbacks and provides a significantly improved sideseal closure cap and sealed package.

The improved cap and container finish utilize a design wherein a gasket receiving channel in the cap is positioned in the lower portion of the cap skirt and where the cooperating sealing surface on the container is spaced downwardly from the container rim. This arrangement, as contrasted with packages having their sideseal immediately adjacent to the container rim, combines additional advantages with the improvements noted above. For example, this design places the glass sealing surface in a position spaced from the critical rim area where most imperfections occur in the molded glass containers. This arrangement also improves the sealing action of the gasket in that the lower portion of the skirt acts as a spring or flexing area to provide for a tight gripping action between the cut gasket and the container seal surface.

Accordingly, an object of the present invention is to provide an improved sideseal closure cap.

Another object of the invention is to provide an improved sidesealed package.

Another object of the invention is to provide an improved sideseal press-on closure cap where any rolling action of a cut gasket during cap application is minimized regardless of the cap size.

Another object of the invention is to provide an improved cut ring sideseal closure cap suitable for larger diameter containers.

Another object of the invention is to provide an improved sideseal closure cap and sealed package having improved cap application and removal characteristics.

Other and further objects of the invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings forming a part of the specification, wherein:

FIG. 1 is a side elevational view partially in section illustrating a preferred embodiment of a sideseal closure and sealed package in accordance with the present invention.

FIGS. 2 and 3 are enlarged detailed vertical sectional views illustrating a preferred embodiment of the closure cap prior to and after being sealed.

FIGS. 4, 5 and 6 are diagrammatic vertical sectional views illustrating three steps during the formation of the metal cap skirt.

DESCRIPTION OF THE PREFERRED EMBODIMENT

FIG. 1 illustrates the preferred sealed package 1 of the present invention. The closure cap 2 has been applied to the container 3 forming a hermetic seal between the gasket 4 in the cap 2 and a sealing surface 5 on the container 3.

The preferred embodiment of the closure cap 2 is applied in this manner, i.e. pressed onto the container 3. Automatic sealing machinery may be used in which suitable sealing heads press the closure caps 2 directly downwardly onto the containers 3 in forming the sealed package 1. Such a sealing operation may be performed at high speeds and with differing diameter containers including large diameter containers without objectionable rolling of the cap gaskets 4.

FIGS. 2 and 3 illustrate in detail the improved closure cap design and gasket configuration including the preferred relative proportions of the cap shell, gasket, and container finish which provide the several advantages referred to above. The improved closure cap 2 comprises a metal shell which is stamped, coaxed, and curled from a metal blank to the preferred shape illustrated in FIGS. 2 and 3. This preferred shape comprises a cover 6 having a recessed stacking panel 7 (FIG. 1) and also, if desired, a dome-like vacuum indicator panel 8 at the center of the cap cover 6. The cap skirt 9 has a step-like shape with a generally vertical upper portion 10 connecting through an inwardly directed bead 11 to a horizontal shoulder portion 12. The horizontal shoulder portion 12 cooperates with the bead 11, a generally vertical low skirt portion 13, and an inwardly rolled bead 14 to form the improved gasket receiving channel 15. The lower skirt portion 13 preferably has a shallow V-shaped cross-section, as illustrated, for providing an improved gasket engaging surface.

The rubber or rubber-like annular gasket 4 is positioned in the channel 15 with the outer gasket surface 16 being positioned at the lower skirt portion or channel bottom 13 and with the lower gasket surface 17 being positioned at the rolled in bead 11. The outer diameter of the gasket 4 is preferably proportioned so that the gasket 4 is under a very slight amount of compression when it is positioned in the cap 2 so that it is retained within the channel 15 during cap transportation, storage, and handling prior to the package sealing operation.

FIGS. 4 through 6 illustrate the successive steps by which the preferred embodiment of the cap skirt is shaped including the gasket receiving channel 15. FIG. 4 illustrates the cap shell after a stamping operation during which the flat cap blank is formed into a cup-like shape with the preliminary stepped outline of the cap skirt having been formed. FIG. 5 illustrates the succeeding coaxing or rolling step wherein the bead 11 has been rolled into the skirt and initial coaxing or turning in of the lower edge of the skirt has begun with the formation of an inwardly directed flange 18. FIG. 6 illustrates the cap shell at the completion of the bead 14 curling step at which point the shell shaping has been completed preparatory to the gasket 4 insertion.

The cut rubber gasket 4 which is inserted into the channel 15 in the closure cap 2 has preferred dimensions which produce a gasket 4 having unexpectedly improved resistance against rolling during cap application while, at the same time, providing a superor hermetic seal between the closure cap 2 and the associated sealing surface 5 on the glass container 3. The gasket 4 as illustrated, for example in FIG. 2, illustrates a preferred cross-section of the cut rubber gasket 4. As illustrated in FIG. 2, a preferred ratio of wall thickness W to gasket cut C is about 80%. This ratio, for example, provides for improved roll resistance in gaskets for typical 70 mm closure caps. This gasket ratio also provides improved roll resistance for gaskets having dimensions which may be somewhat larger and smaller than 70 mm caps as, for example, for the widely used 66 mm closure caps or somewhat smaller caps. The cut rubber gasket 4 with these cross-sectional proportions and fitted into the channel 15 of a closure cap 2 shell of the general shape described above including the bead 11 provides the improved results discussed above.

The preferred channel shaping for seating the gasket 4 preferably has a shallow V-shaped cross-section where the upper and lower legs of the V form an acute angle of about 5°–10°with the vertical or with the container axis. This shaping of the lower portion 13 of the skirt 9 firmly positions the gasket 4 in place with respect to the cap shell and the glass finish when the cap 2 has been pressed downwardly into sealing relationship as illustrated in FIG. 3.

The shoulder 12, partially formed by the inwardly directed bead 11, extends radially inwardly over a substantial portion of the gasket top 19 during the initial downward movement of the cap 2 during the sealing operation as seen in FIG. 2 to provide an anti-rolling action. During the final portion of the sealing as the cap reaches the position shown in FIG. 3, the compression of the gasket 4 places it more fully under the shoulder 12 which continues to act as a bar against the gasket rolling should it occur.

The preferred glass finish for the container 3 has two principal surfaces which comprise an outwardly and downwardly flared or tapered guide surface 20 which leads downwardly to the generally vertical annular sealing surface 5. The flared guide surface 20 facilitates the cap application by acting as a camming or guiding surface for the gasket and also acts to facilitate cap removal by virtue of its tapered effect providing decreasing resistance as the closure cap is levered or lifted off the container 3. Improved results, in both of these respects, are obtained by a slightly concaved shaping of this surface in cross-section in the form illustrated in FIGS. 2 and 3.

The sealing surface 5 is seen to extend for a distance slightly greater than the length of the sealing surface of the gasket when the gasket has been compressed into sealing relationship in the manner illustrated in FIG. 3. An improved seal retention action is obtained by the slightly concaved shaping of the sealing surface 5 in cross-section as also illustrated in FIGS. 2 and 3. A preferred container shape includes a shoulder 21 below the sealing surface 5 to facilitate cap removal either resulting from an enlargement of the container diameter below the sealing surface, as illustrated, or by the provision of an outwardly directed pry-off shoulder formed in the glass container 3 surface at this position.

It will be seen that an improved sideseal closure cap and sealed package are provided where the container sealing operation may be performed at high speeds and with large diameter closure caps without sealing failures resulting from rolling action of the sealing gasket. These improved results are obtained with a sideseal closure which provides a sure seal. The container sealing surface is spaced downwardly from the container rim for minimizing problems relating from possible imperfections in the glass at the container rim and a relatively long surface contact is provided between the sealing gasket and the container sealing surface.

As various changes may be made in the form, construction and arrangement of the parts herein without departing from the spirit and scope of the invention and without sacrificing any of its advantages, it is to be understood that all matter herein is to be interpreted as illustrative and not in a limiting sense.

What is claimed is:

1. A closure cap having a cover portion and a generally cylindrical depending skirt portion, said skirt portion having a step in its top portion with a vertical upper portion and a horizontal shoulder joining at an annular inwardly directed bead of U-shaped cross-section with the bead being the radially innermost portion of said skirt portion and extending radially inwardly of said step vertical portion, the lower edge of said skirt portion comprising an inwardly rolled second bead, said beads being connected by a V-shaped portion of said skirt to form a gasket receiving channel, an annular cut gasket positioned within said gasket receiving channel having a rectangular cross-section with the cross-sectional depth exceeding the cross-sectional width, and the radially inward edges of said beads extending more than half way inwardly of the gasket width.

2. The closure cap as claimed in claim 1 in which said width equals about 80 degrees of said depth.

3. A sealed package comprising the combination of a container with the finish of said container having a flared cap guiding surface extending downwardly and outwardly from the container rim and a generally vertical sealing surface therebelow, said surfaces being concave in vertical cross-section and being of substantially equal lengths, and a closure cap having a cover portion and a depending skirt portion, said skirt portion having a step in its top portion with a vertical upper portion and a horizontal shoulder joining at an annular inwardly directed U-shaped bead extending radially inwardly of said step vertical upper portion, the lower edge of said skirt portion comprising an inwardly rolled second bead, said beads being connected by a V-shaped portion of said skirt to form a gasket receiving channel, an annular gasket positioned within said gasket receiving channel and engaging said sealing surface and having a rectangular corss-section with the cross-sectional depth exceeding the cross-sectional width and engaging substantially the entire concave surface of said container finish sealing surface, and the radially inward edges of said beads extending more than half way inwardly of the gasket width.

4. The sealed package as claimed in claim 3 in which said width equals about 80 degrees of said depth.

5. A container comprising a finish having a guide surface extending downwardly and outwardly from a container rim, a generally vertical sealing surface extending downwardly from the lower edge of said guide surface, and said surfaces being concave throughout their cross-sections and of substantially equal cross-sectional lengths.

* * * * *